US010810943B2

(12) United States Patent
Yum et al.

(10) Patent No.: US 10,810,943 B2
(45) Date of Patent: Oct. 20, 2020

(54) DISPLAY DRIVER, DISPLAY SYSTEM, AND OPERATION METHOD OF THE DISPLAY DRIVER

(71) Applicant: SAMSUNG ELECTRONICS CO., LTD., Suwon-si, Gyeonggi-Do (KR)

(72) Inventors: Joo-Hyuk Yum, Yongin-si (KR); Yong-Hoon Yu, Suwon-si (KR); Jae-Youl Lee, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 16/402,794

(22) Filed: May 3, 2019

(65) Prior Publication Data

US 2019/0340980 A1 Nov. 7, 2019

(30) Foreign Application Priority Data

May 4, 2018 (KR) ..... 10-2018-0052132

(51) Int. Cl.

| | |
|---|---|
| ***G09G 3/30*** | (2006.01) |
| ***G09G 3/3258*** | (2016.01) |
| ***G09G 3/3233*** | (2016.01) |

(52) U.S. Cl.

CPC ..... *G09G 3/3258* (2013.01); *G09G 3/3233* (2013.01); *G09G 2320/0223* (2013.01); *G09G 2320/0233* (2013.01)

(58) Field of Classification Search

CPC ..... G09G 3/3258; G09G 3/3233; G09G 2320/0233; G09G 2320/0223; G09G 3/3225; G09G 2360/16; G09G 2320/0285; G09G 3/3208

See application file for complete search history.

(56) References Cited

U.S. PATENT DOCUMENTS

| | | | |
|---|---|---|---|
| 9,715,849 | B2 | 7/2017 | Fujii |
| 2017/0032742 | A1 | 2/2017 | Piper et al. |

*Primary Examiner* — Adam R. Giesy

(74) *Attorney, Agent, or Firm* — Volentine, Whitt & Francos, PLLC

(57) ABSTRACT

A display driver includes: a compensator configured to divide an input image into a plurality of blocks having a plurality of columns and a plurality of rows, generate a first current map in which a current magnitude corresponding to each of the plurality of blocks has been calculated, generate a second current map based on a cumulative summation of the current magnitude of the block located on each column of the first current map in a column direction, and generate output data by compensating pixel values of the input image based on a third current map in which the current magnitude of the block located on each row of the second current map has been adjusted with respect to a position in a row direction; and a data driver configured to generate an output image based on the output data and provide the output image to a display panel.

20 Claims, 13 Drawing Sheets

DISPLAY DRIVER, DISPLAY SYSTEM, AND OPERATION METHOD OF THE DISPLAY DRIVER

CROSS-REFERENCE TO RELATED APPLICATION

This application claims the benefit of Korean Patent Application No. 10-2018-0052132, filed on May 4, 2018, in the Korean Intellectual Property Office, the disclosure of which is incorporated herein in its entirety by reference.

BACKGROUND

The disclosure relates to a display driver, a display system, and an operation method of the display driver, and more particularly, to a display driver for adjusting pixel values of an input image, a display system, and an operation method of the display driver.

Electronic devices having an image display function, such as a computer, a tablet personal computer (PC), and a smart phone may include a display system. The display system may include a display panel, a display driver (or a display driver integrated circuit (IC) (DDI)), and a host processor. The display panel may include a plurality of pixels and may be implemented as a flat panel display using an organic light-emitting diode (OLED). The display driver may drive the display panel based on image data. An image may be displayed on the display panel as the pixels are driven by data signals (display data) provided by the display driver. The display driver may receive control signals and the image data from the host processor. The host processor may periodically transmit the image data to the display driver. The host processor and the display driver may send and receive signals via a high-speed interface.

SUMMARY

The disclosure provides a display driver for adjusting pixel values of an input image to compensate for a voltage drop of a display panel, a display system, and an operation method of the display driver.

According to an aspect of the disclosure, there is provided a display driver including: a compensator configured to divide an input image into a plurality of blocks having a plurality of columns and a plurality of rows, generate a first current map in which a current magnitude corresponding to each of the plurality of blocks has been calculated, generate a second current map based on a cumulative calculation of the current magnitude of the block located on each column of the first current map in a column direction, and generate output data by compensating pixel values of the input image based on a third current map in which the current magnitude of the block located on each row of the second current map has been adjusted with respect to a position in a row direction; and a data driver configured to generate an output image based on the output data and provide the output image to a display panel.

According to another aspect of the disclosure, there is provided an operation method of a display driver, the operation method including: generating a first current map by dividing a received input image into a plurality of blocks having a plurality of rows and a plurality of columns, and calculating a current magnitude corresponding to each of the plurality of blocks based on pixel values included in each of the plurality of blocks; generating a second current map by cumulatively calculating the current magnitudes of blocks located on each column of the first current map; generating a voltage drop compensation map based on a third current map in which weights based on positions in a row direction are applied to the current magnitudes of blocks located on each row of the second current map; generating output data by compensating the pixel values based on the voltage drop compensation map; and generating an output image based on the output data and providing the output image to a display panel.

According to another aspect of the disclosure, there is provided a display system including: a display panel; and a display driver configured to divide an input image into a plurality of blocks having a plurality of columns and a plurality of rows, generate a first current map in which a current magnitude corresponding to each of the plurality of blocks has been calculated, generate a second current map by adjusting the current magnitudes of the blocks located on each column of the first current map, generate output data in which the pixel values have been adjusted based on a third current map in which the current magnitude of the block located on each row of the second current map has been adjusted, and provide the output image generated based on the output data to the display panel.

According to another aspect of the disclosure, there is provided a display system having a display driver and a display panel. The display driver generates first and second output pixel values of an output image by applying a first compensation value to a first input pixel value and a second compensation value to a second input pixel value. The first and second input pixel values constitute part of an input image, and the first compensation value differs from the second compensation value. The display panel displays the output image.

BRIEF DESCRIPTION OF THE DRAWINGS

Embodiments of the disclosure will be more clearly understood from the following detailed description taken in conjunction with the accompanying drawings in which.

DETAILED DESCRIPTION OF THE EMBODIMENTS

Hereinafter, embodiments of the disclosure will be described in detail with reference to the accompanying drawings.

Figure 1:
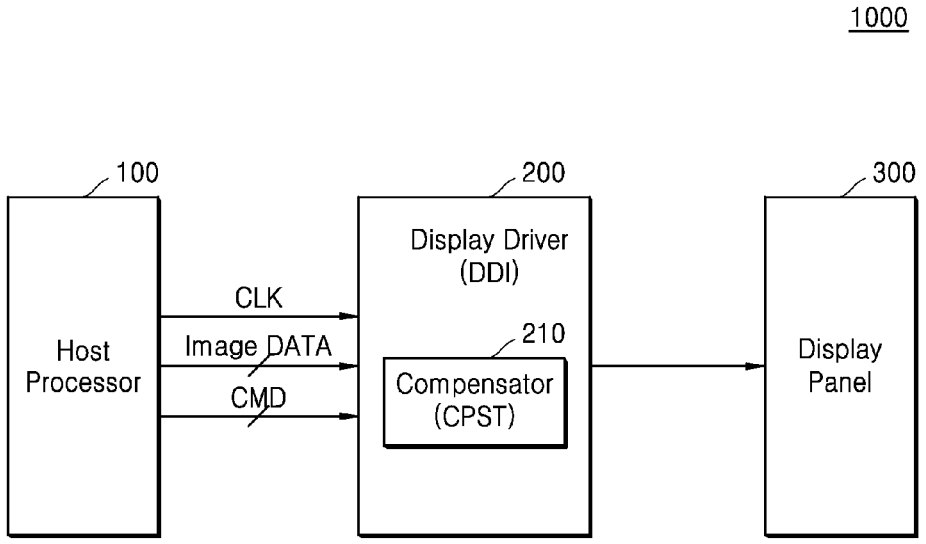
FIG. 1 is a block diagram illustrating a display system according to an embodiment.

FIG. 1 is a block diagram illustrating a display system 1000 according to an embodiment.

The display system 1000 may be implemented in mobile devices such as a mobile phone, a smart phone, a tablet personal computer (PC), a personal digital assistant (PDA), a wearable electronic device, and a portable multimedia player (PDP), a handheld device, or a handheld computer. In addition, the display system 1000 may also be implemented in various electronic devices such as a TV, a notebook, a desktop PC, and a navigation device.

Referring to FIG. 1, the display system 1000 may include a host processor 100, a display driver (or display driver integrated circuit (DDI)) 200, and a display panel 300. The host processor 100 and the display driver 200 may be implemented as separate chips or may be implemented as a single module, a system on chip, or a single package (for example, a multi-chip package). According to another embodiment, the display driver 200 and the display panel 300 may be implemented as a single module.

The host processor 100 may control an overall operation of the display system 1000. The host processor 100 may be implemented as an application processor (AP), a baseband processor (BBP), a micro processing unit (MPU), etc.

The host processor 100 may transmit to the display driver 200 image data Image DATA and control signals required for an operation of the display driver 200. For example, the image data Image DATA may be image data about an input image and may be data that includes a plurality of red/green/blue (RGB) pixel values and has a resolution of w*h, in which a width of the resolution is formed by w pixels and a height of the resolution is formed by h pixels.

The control signals may include a clock signal CLK, a command signal CMD, a horizontal synchronization signal, a vertical synchronization signal, and a data enable signal. As an example, the image data and the control signals may be provided to the display driver 200 as packet data.

The command signal CMD may include a signal for controlling image processing performed by the display driver 200, image information, or display environment configuration information.

The signal for controlling the image processing may be, for example, a control signal which controls a compensator CPST 210 included in the display driver 200 to adjust the pixel value of the input image and output the adjusted pixel value.

The image information may be information about the image data Image DATA input to the display driver 200 and may include, for example, resolution, pixel values (for example, RGB pixel values), etc.

The display environment configuration information may include, for example, panel information, a brightness value, a luminance value, a saturation value, etc. For example, the host processor 100 may transmit to the display driver 200 the display environment configuration information according to a user input of the display panel 300 or preset display environment configuration information.

The display driver 200 may drive the display panel 300 based on image data Image DATA and the control signals received from the host processor 100. The display driver 200 may convert image data Image DATA, which is a digital signal, into an analog signal and may drive the display panel 300 by using the analog signal.

The display driver 200 may include the compensator CPST 210, and the compensator CPST 210 may compensate for the pixel values of the input image considering a voltage drop of a driving voltage (for example, ELVDD in FIG. 2) provided to the display panel 300 and provide to the display panel 300 the input image for which the pixel values have been compensated. The driving voltage ELVDD may be a voltage commonly provided to pixels provided in the display panel 300. For example, a voltage-drop amount of the driving voltage ELVDD may be different for the pixels depending on positions thereof and the pixel values respectively corresponding thereto. Thus, the compensator CPST 210 may estimate the voltage drop amount of the driving voltage ELVDD for each of the pixels or for each block including the plurality of pixels based on the pixel values and may compensate the pixel values based on the estimated voltage drop amount.

The compensator CPST 210 may divide the pixel values of the image data Image DATA into a plurality of blocks based on the image data Image DATA and the control signal received from the host processor 100 and may generate a current map in which magnitudes of current consumed by the pixels corresponding to each block are calculated.

The compensator CPST 210 may generate the current map in which the magnitudes of current are newly calculated based on the magnitudes of current included in the respective blocks in a column direction and a row direction of the generated current map. In the following description, a direction in which the driving voltage ELVDD is applied is defined as the column direction, and a direction perpendicular to the column direction is defined as the row direction. In the case when the driving voltage ELVDD is applied to the display panel 300, the voltage drop of the driving voltage ELVDD may increase in the display panel 300 away from the position where the driving voltage ELVDD has been applied. Hereinafter, the voltage drop may denote the voltage drop of the driving voltage ELVDD.

The compensator CPST 210 may calculate a voltage drop (IR-drop) map according to a current map having the newly calculated magnitudes of the current and a resistance value of the display panel 300 (for example, the resistance value of a parasitic resistance of wirings provided with the driving voltage ELVDD in the display panel 300), and may adjust the pixel values by applying data based on the calculated IR-drop map. For example, information about the resistance value and the position where the driving voltage ELVDD is applied may be values that have been already stored in a storage unit of the display driver 200. As another example, the host processor 100 may provide information about the resistance value of the display panel 300 and the position where the driving voltage ELVDD is applied.

Accordingly, the display panel 300 may output an image in which the pixel values are adjusted, and the display driver 200 may compensate for the voltage drop physically generated in the display panel 300 so that luminance, colors, etc. of the image to be output to the display panel 300 may be uniformly expressed.

Figure 2:
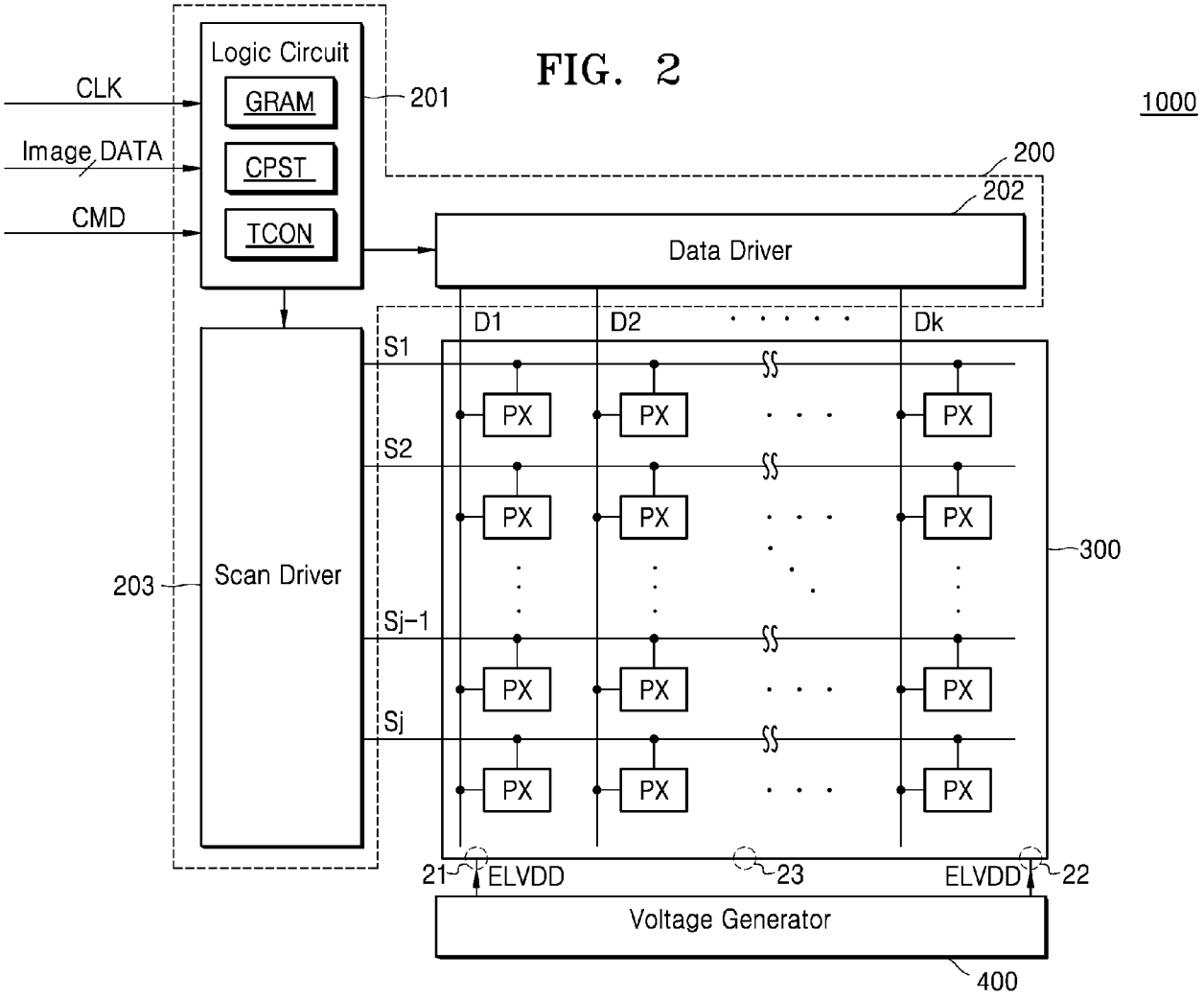
FIG. 2 is a detailed block diagram for explaining a display system according to an embodiment.

FIG. 2 is a detailed block diagram illustrating the display system 1000 according to an embodiment.

Referring to FIG. 2, the display system 1000 may include the display driver 200, the display panel 300, and a voltage generator 400.

The display system 1000 may be an organic light-emitting display system, and the display panel 300 may be an organic light-emitting diode panel. However, the organic light-emitting diode may be only an example and various types of light-emitting diodes may be included in the display system 1000.

In the display panel 300, a plurality of pixels PX may be arranged and each pixel PX may include the organic light-emitting diode which emits light in response to a current flow. The plurality of pixels PX may receive the driving voltage ELVDD from the voltage generator 400. A structure in which the driving voltage ELVDD is applied to the plurality of pixels PX is described later in detail with reference to FIG. 3. A wiring between the voltage generator 400 and the pixel PX, and a wiring between the pixels PX may include resistance components. Accordingly, a voltage less than the driving voltage ELVDD may be applied to the pixel PX located far away from the voltage generator 400. The reason may be because the voltage drop due to the resistance components is accumulated.

In the display panel 300, j scanning lines S1 through Sj for transmitting scan signals in the row direction, and k data lines D1 through Dk for transmitting data signals in the column direction may be arranged.

The voltage generator 400 may generate the driving voltage ELVDD and provide the driving voltage ELVDD to the display panel 300. The voltage generator 400 may provide the driving voltage ELVDD to one side of the display panel 300, and the driving voltage ELVDD may be provided to each of the pixels PX via the wirings provided in the display panel 300. For example, the voltage generator 400 may apply the driving voltage ELVDD to terminals arranged at two positions 21 and 22 of the display panel 300 as illustrated in FIG. 2. As another example, the voltage generator 400 may apply the driving voltage ELVDD to at least one terminal arranged at a particular position 23 of the display panel 300, which is to be described later with reference to FIG. 3.

The display driver 200 may generate the scan signal and the data signal and transmit the generated scan signal and the data signal to the display panel 300. The display driver 200 may include a logic circuit 201, a data driver 202, and a scan driver 203. These components may be respectively formed on separate semiconductor integrated circuits (IC) or may be integrated in one semiconductor IC.

The logic circuit 201 may include graphics random-access memory (RAM) GRAM, the compensator CPST, and a timing controller TCON. Each component may be constituted by one semiconductor IC or by an individual semiconductor IC. The compensator CPST and/or the timing controller TCON may be implemented by hardware, software, or a combination thereof, which perform functions and/or operations described below. For example, the compensator CPST may include one or more instances of hardware (for example, an electronic circuit) collectively configured to implement the functions described below in the disclosure. As another example, the compensator CPST may be implemented as a program that includes instructions or procedures for performing the functions described below in the disclosure and may be executed by any processor included in the display system 1000.

The GRAM may store image data Image DATA received from the outside or image data Image DATA received from the compensator CPST. The GRAM may store display data for one frame and may sequentially transmit to the data driver 202 the display data corresponding to one horizontal line to be displayed.

The compensator CPST may adjust the pixel value to be transmitted to the data driver 202. In one example, the compensator CPST may lower the pixel value of the pixel PX in which the voltage drop is small. The compensator CPST may calculate a magnitude of the voltage drop occurring in each pixel in the display panel 300 based on the pixel value of the image data Image DATA, transmit to the timing controller TCON data having the adjusted pixel value of each pixel PX based on the magnitude of the voltage drop so that the data having the adjusted pixel value is displayed on the display panel 300.

The timing controller TCON may generate the control signal for controlling the data driver 202 and the scan driver 203 and transmit to the data driver 202 an image signal received from the outside. The timing controller TCON may transmit an image output from the GRAM to the data driver 202.

The data driver 202 may output a gradation voltage corresponding to the output image data Image DATA to the first through kth data lines D1 through Dk of the display panel 300 according to the control signal provided from the logic circuit 201 and the driving voltage ELVDD provided from the voltage generator 400.

The scan driver 203 may be connected to first through jth scan lines S1 through Sj of the display panel 300 to transmit the scan signals to a specific row of the display panel 300. The data signal output from the data driver 202, for example, the gradation voltage, may be transmitted to the pixel PX to which the scanning signal has been transmitted.

The characteristics of the present disclosure may be applied to display devices having a driving method similar to that of an organic light-emitting diode display. For example, display devices may include at least any one of a liquid crystal display (LCD), an organic light-emitting diode (OLED) display, a light-emitting diode (LED) display, an electro-chromic display (ECD), a digital mirror device (DMD), a grating light valve (GLV), a plasma display panel (PDP), an electro luminescent display (ELD), and a vacuum fluorescent display (VFD).

Figure 3:
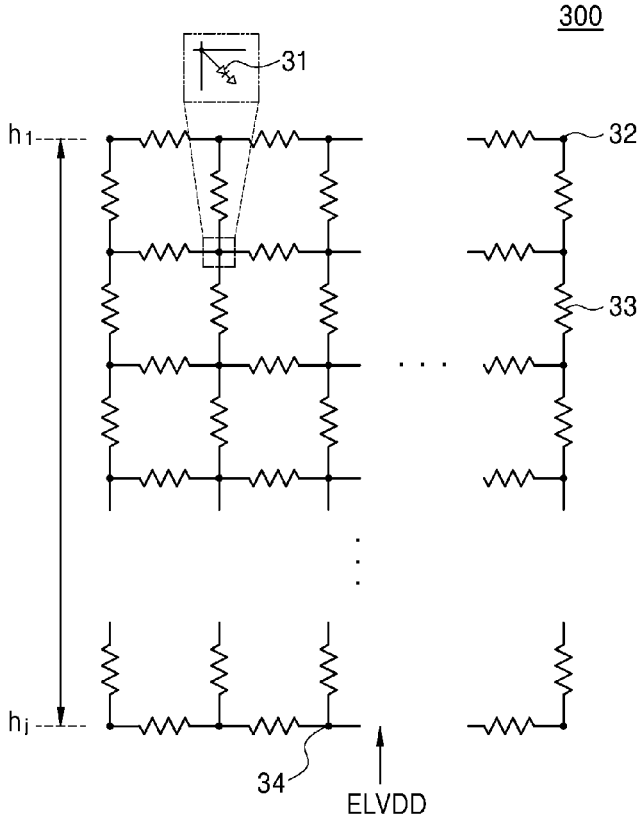
FIG. 3 is a diagram illustrating a display panel according to an embodiment.

FIG. 3 is a diagram illustrating the display panel 300 according to an embodiment.

The display panel 300 according to an embodiment may have resistance in a mesh type. The display panel 300 may have k pixels PX in the row direction and j pixels PX in the column direction. The pixels PX arranged at the each node may be self-luminous elements. As an example, as illustrated, the pixel PX may include an LED element 31. For example, in the pixel PX, an amount of light output from the LED element 31 may vary depending on the magnitude of the driving voltage ELVDD.

The driving voltage ELVDD input to the display panel 300 may be provided to each of a plurality of pixels 32 via wirings of a mesh type structure. In this process, the voltage drop may occur due to the resistance component 33 according to the wirings between the plurality of pixels 32. In addition, the voltage drop may also occur due to the resistance component depending on the wiring between the pixel PX and the terminal to which the driving voltage ELVDD is applied. On the other hand, referring to FIG. 3, a direction in which the driving voltage ELVDD is applied is illustrated at a bottom portion of the display panel 300, but the embodiment is not limited thereto. In other words, the driving voltage ELVDD may be applied to a top portion, a left portion, or a right portion of the display panel 300. In addition, the driving voltage ELVDD is illustrated as being applied at only one position, but the driving voltage ELVDD may be applied to the display panel 300 via the terminals at the plurality of positions as illustrated in FIG. 2.

Referring to FIG. 3, the voltage drop with respect to the pixel 34 close to the terminal to which the driving voltage ELVDD is applied may be small, and the voltage drops with respect to the plurality of pixels 32 remote from the terminal to which the driving voltage ELVDD is applied may be large. Accordingly, the display driver 200 according to the disclosure may adjust the pixel values considering the magnitudes of the voltage drops occurring with respect to the pixels PX of the display panel 300, thereby achieving luminance uniformity.

Figure 4A:
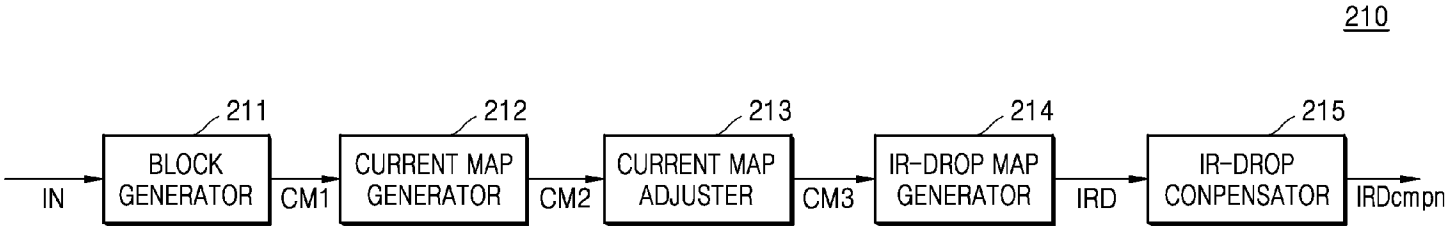
FIG. 4A is a block diagram for explaining a compensator according to an embodiment.
Figure 4B:
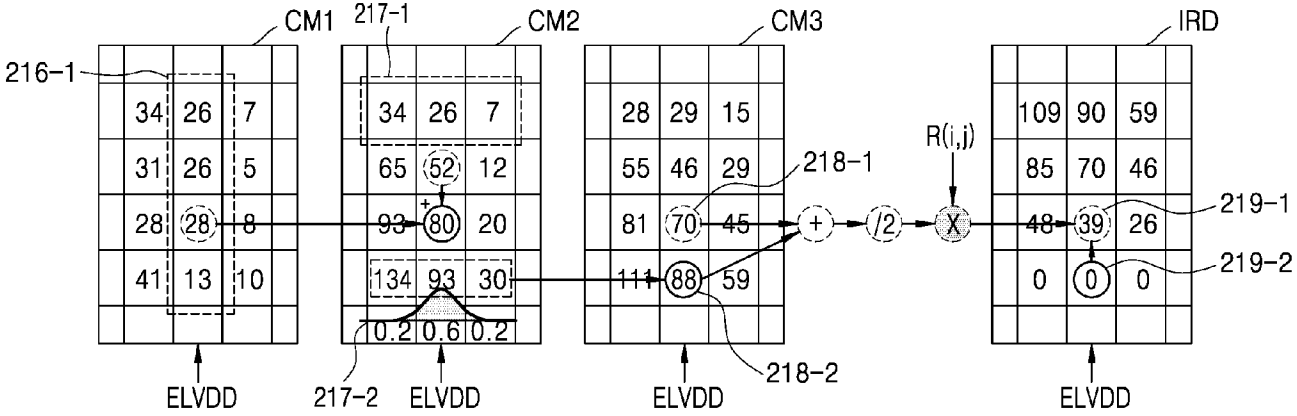
FIG. 4B is a block diagram for explaining data generated by the compensator.

FIG. 4A is a block diagram for explaining the compensator CPST 210 according to an embodiment, and FIG. 4B is a block diagram for explaining data generated by the compensator CPST 210.

Referring to FIG. 4A, the compensator CPST 210 may include a block generator 211, a current map generator 212, a current map adjuster 213, a voltage drop (IR-drop) map generator 214, and a voltage drop (IR-drop) compensator 215.

Referring to FIG. 4A, the block generator 211 may receive input image data IN. The input image data IN may be data on an image of pixels having a w×h resolution. The input image data IN may be represented by various data such as the pixel value, a voltage value, and a current value of each pixel PX. The pixel value of each pixel PX of the input image data IN may be expressed as in(x, y), where x and y satisfy 0<=x<w and 0<=y<h, respectively. Here, x and y may represent coordinates corresponding to the display panel 300.

The block generator 211 may divide received input image data IN into a plurality of blocks having a plurality of rows and a plurality of columns, calculate an average of current magnitudes of pixels PX corresponding to each block, and accordingly, generate a first current map CM1. In the first current map CM1, the current magnitude of each block may be represented by I(i, j), where i and j satisfy 0<=i<A and 0<=j<B, respectively. Here, A and B may denote the number of blocks in a horizontal direction and a vertical direction, respectively, and i and j may denote the coordinates of a block map.

The block generator 211 may set the number of horizontal blocks A and the number of vertical blocks B to be less than the number of horizontal pixels (or w) and the number of vertical pixels (or h) of the input image, respectively. This setting may be performed to reduce the amount of computations for future image processing.

On the other hand, the block generator 211 may obtain the current magnitude according to the pixel value of the display panel 300 and may calculate the average value of the amount of current consumed by the plurality of pixels PX corresponding to each block.

Referring to FIG. 4B, the first current map CM1 may represent the average amount of current consumed by the pixels PX corresponding to each of the plurality of blocks.

The current map generator 212 may generate a second current map CM2 that adjusts the current magnitudes of the blocks located on the respective columns of the first current map CM1, and the current map adjuster 213 may generate a third current map CM3 by adjusting the current magnitudes of the blocks located on the respective rows of the second current map CM2.

The current map generator 212 may determine a new current magnitude of a first block by adding the existing current magnitude of the first block included in the first current map CM1 and the current magnitude of a second block which is a row adjacent to the first block. In the second current map CM2, the current magnitude of each block may be represented by C(i, j).

Referring to FIG. 4B, when the driving voltage ELVDD is applied to a bottom end of the display panel 300, the current map generator 212 may generate the second current map CM2 for each column of the first current map CM1 by sequentially summing from the current magnitude for a top block to the current magnitude for a bottom block.

For example, for a particular column 216-1 to which the driving voltage ELVDD is applied in the first current map CM1, it is assumed that the current magnitudes of the blocks of the particular column 216-1 are 26, 26, 28, and 13, respectively. In this case, the current map generator 212 may calculate the current magnitudes corresponding to the blocks of the corresponding column as 26, 26+26=52, 26+26+28=80, and 26+26+28+13=93, and then may generate the second current map CM2. On the other hand, in the first and second current maps CM1 and CM2, a row 217-1 having the current magnitudes of 34, 26, and 7 may have the current magnitude corresponding to a block located at the top of the display panel 300.

Referring further to FIG. 4A, the current map adjuster 213 may adjust the current magnitudes included in the row of the blocks constituting the second current map CM2 based on a Gaussian filter. In this case, the current map adjuster 213 may perform filtering on the current magnitude input to a center value of the Gaussian filter by the current magnitude of a block close to a position to which the driving voltage ELVDD is applied. The current map adjuster 213 may generate a third current map CM3 by performing a low-pass filtering process on the second current map CM2. For example, the low-pass filtering process may be performed by using a Gaussian kernel filter. In the third current map CM3, the current magnitude of each block may be denoted as wC(i, j) and may be expressed as Formula 1.

$$wC(i,j)=\mathrm{conv}(C(i,j),w(i)) \quad \text{[Formula 1]}$$

The conv in Formula 1 may represent a convolution operation. The current magnitude of each block of the third current map CM3 may be calculated by the convolution operation of the current magnitude C(i, j) of each block of the second current map CM2 and the kernel of the filter w(i). Here, w(i) may denote the kernel of the filter for the $i^{th}$ column. For example, as illustrated in FIG. 4B, the kernel of the filter 217-2 may have values of 0.2, 0.6, and 0.2 for each block. On the other hand, the filter may vary depending on a type of the display panel 300, and for example, may be implemented as the Gaussian filter. Depending on the type of the display panel 300, filters having different Gaussian kernels or different Gaussian sigma values may be used.

In an embodiment of FIG. 4B, the driving voltage ELVDD is applied at the center of one side of the display panel 300. However, according to another embodiment, the driving voltage ELVDD may be applied to two ends of the one side of the display panel 300. In this case, a plurality of driving voltages ELVDD may be voltages supplied from an identical voltage source. Even in this case, the current map adjuster 213 may adjust the current magnitude as described in the above-described embodiment.

According to FIG. 4A, the IR-drop map generator 214 may generate the IR-drop map IRD based on the third current map CM3.

The IR-drop map generator 214 may provide an output image in which the pixel value of the input image has been adjusted based on the IR-drop map IRD obtained by multiplying the third current map CM3 by the resistance value corresponding to each block of the display panel 300. For example, the IR-drop map generator 214 may calculate an average resistance value based on information about the number and the resistance value of pixels PX included in each block and multiply the third current map CM3 by the average resistance value.

Referring to FIG. 4B, the IR-drop map generator 214 may generate the IR-drop map IRD by multiplying the resistance value by an average of the current magnitude of a third block 218-1 included in the third current map CM3 and the current magnitude of a fourth block 218-2, which is a row adjacent to the third block 218-1.

In this case, the IR-drop map generator 214 may set to zero the blocks in a row proximate to a side to which the driving voltage ELVDD is supplied in the IR-drop map IRD. Since the pixel PX near the position to which the driving voltage ELVDD is applied has a short wiring length, the resistance component and the voltage drop thereof may be small, and thus, a voltage thereof may be used as a reference potential.

Thereafter, in the third current map CM3, the IR-drop map generator 214 may add 70 and 88, which are respectively the current values of the third block 218-1 and the fourth block 218-2 located on a same column, and divide a result thereof by 2; may calculate the voltage drop value of 39 by multiplying the divided result by the resistance value distributed between the third block 218-1 and the fourth block 218-2; may add the calculated voltage drop value and 0, which is the voltage drop value of a block 219-2 of the IR-drop map IRD corresponding to the fourth block 218-2; and may write 39, which is a result of the addition, in a block 219-1 of the IR-drop map IRD corresponding to the third block 218-1. A voltage drop value may be obtained by multiplying an average magnitude of current passing through two blocks on a same column by a resistance value R(i,j) according to Ohm's law. Accordingly, the IR-drop map generator 214 may generate the IR-drop map IRD by sequentially writing the voltage drop magnitude for the plurality of blocks from the block on the side to which the drive voltage EVLDD is applied.

Referring again to FIG. 4A, the IR-drop compensator 215 may generate an IR-drop compensation map IRDcmpn by subtracting the voltage drop magnitude of each of the plurality of blocks of the IR-drop map IRD from a maximum voltage drop magnitude IRDmax included in the IR-drop map IRD as shown in Formula 2, and may provide the output image by applying the IR-drop compensation map IRDcmpn to the input image. In Formula 2, IRDcmpn(i, j) and IRD(i, j) may denote the voltage drop values of the blocks included in the IR-drop compensation map IRDcmpn and the IR-drop map IRD, respectively.

$$\mathrm{IRD}_{cmpn}=\mathrm{IRD}_{max}-\mathrm{IRD}(i,j) \quad \text{[Formula 2]}$$

In this case, the IR-drop compensator 215 may generate an IR-drop compensation map IRDcmpn having voltage compensation magnitudes in units of pixels from an IR-drop compensation map IRDcmpn having voltage compensation magnitudes in units of blocks and may generate an IR-drop compensation map IRDcmpn having voltage drop magnitudes in units of pixels with the same resolution as the input image. In this case, the IR-drop compensator 215 may generate data in units of pixels from data in units of blocks by using various interpolation methods such as linear interpolation.

According to an embodiment, the IR-drop compensator 215 may provide the compensation data by multiplying the IR-drop compensation map IRDcmpn having the voltage drop magnitudes in units of pixels by an adjustment coefficient $\omega_{calib}$. The IR-drop compensator 215 may, multiply the adjustment coefficient $\omega_{calib}$ to match the voltage drop magnitude calculated by the compensator CPST 210 and the voltage drop magnitude actually generated in the display panel 300, according to a certain set value or received panel information. Accordingly, the pixel value or out(x, y) of the output image to be provided to the display panel 300 may be calculated based on Formula 3 below. Here, IRDcmpn(x, y) may be a voltage compensation value in units of pixels.

$$\mathrm{out}(x,y)=\mathrm{in}(x,y)-\omega_{bright}*\omega_{calib}*\mathrm{IRD}_{cmpn}(x,y) \quad \text{[Formula 3]}$$

On the other hand, when the driving voltage ELVDD is input to a first side of the display panel 300, the compensator CPST 210 may not calculate the current magnitude for a $0^{th}$ row proximate to a second side opposite to the first side. Instead, the current magnitudes of first through $(h-1)^{th}$ rows may be determined by adding the existing current magnitudes of 0th through the $(h-2)^{th}$ rows to the existing current magnitudes of the first through $(h-1)^{th}$ rows. For example, according to FIG. 4B, the driving voltage ELVDD may be input at the bottom portion of the display panel 300. In this case, the current map generator 212 may generate the block value C(i, j) of the second current map CM2 by using Formula 4 below. When j is 0, the 0th row may be denoted as a block row located at the uppermost position in the second current map CM2.

$$\begin{cases} C(i,j)=C(i,j-1)+I(i,j), \text{ when } j\neq 0 \\ C(i,j)=I(i,j), \text{ when } j=0 \end{cases} \quad \text{[Formula 4]}$$

Here, the IR-drop map generator 214 may generate a block value IRD(i, j) of the IR-drop map IRD by using Formula 5 below. In Formula 5, bH may denote the number of rows, j=bH−1 may denote the lowermost block row, and ird_map_gain [j] may include the resistance values between the $j^{th}$ row and the $(j+1)^{th}$ row.

$$\begin{cases} IRD(i,j)=\dfrac{wC(i,j+1)+wC(i,j)}{2}*\text{ird_map_gain}[j]+ \\ \quad IRD(i,j+1), \text{ when } j\neq bH-1 \\ IRD(i,j)=0, \text{ when } j=bH\ 1 \end{cases} \quad \text{[Formula 5]}$$

Unlike an example illustrated in FIG. 4B, the driving voltage ELVDD may be input at the top portion of the display panel 300. In this case, the current map generator 212 may generate the block value C(i, j) of the second current map CM2 by using Formula 6 below.

$$\begin{cases} C(i,j)=C(i,j+1)+I(i,j), \text{ when } j\neq bH-1 \\ C(i,j)=I(i,j), \text{ when } j=bH-1 \end{cases} \quad \text{[Formula 6]}$$

Here, the IR-drop map generator 214 may generate the block value IRD(i, j) of the IR-drop map IRD by using Formula 7 below.

$$\begin{cases} IRD(i, j) = \frac{wC(i, j-1) + wC(i, j)}{2} * \text{ird_map_gain}[j] + \\ \quad IRD(i, j-1), \text{ when } j \neq 0 \\ IRD(i, j) = 0, \text{ when } j = 0 \end{cases} \quad \text{[Formula 7]}$$

In this case, the IR-drop map generator 214 may set the voltage magnitude of the $N^{th}$ row, proximate to the side to which the driving voltage ELVDD is applied, to 0, which denotes IRD(i, 0)=0. This setting is performed to set the pixel PX, which is included in a block adjacent to the side to which the driving voltage ELVDD is applied, as a reference block due to little voltage drop therein.

As described above, the compensator CPST 210 may receive the input image and adjust the pixel values to compensate for the voltage drops occurring in the display panel 300, thereby outputting uniform luminance.

FIG. 5 is a diagram for explaining the IR-drop compensation map IRDcmpn generated by the compensator CPST 210 according to an embodiment.

Figure 5A:
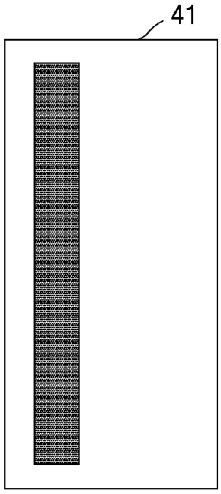
FIG. 5A illustrates an input image having a black object of a width less than a panel width on a white background.
Figure 5B:
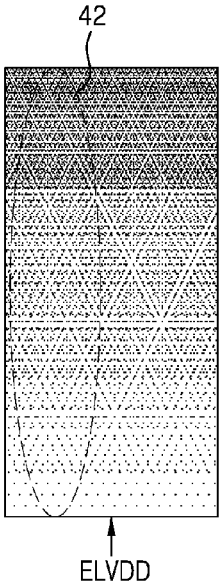
FIG. 5B illustrates data of a voltage drop compensation map when the input image is not considered.
Figure 5C:
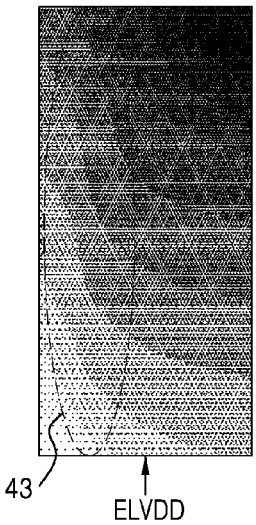
FIG. 5C illustrates data of the voltage drop compensation map when the input image is considered, according to an embodiment.

FIG. 5A illustrates an input image 41 having a black object of a width less than a panel width on a white background, FIG. 5B illustrates data of the IR-drop compensation map IRDcmpn when the input image 41 is not considered, and FIG. 5C illustrates data for the IR-drop compensation map IRDcmpn when the input image 41 is considered according to an embodiment.

FIG. 5B illustrates data compensated for the voltage drop by considering only the current magnitude in a column direction, without the current magnitude in a row direction, even when the input image 41 is input. In other words, the data according to FIG. 5B may be data to compensate for the voltage drop without considering current flowing between the adjacent pixels in the row direction in the display panel 300. Thus, when the input image 41 including the black object on the white background is input as illustrated in FIG. 5A, and the IR-drop compensation map IRDcmpn illustrated in FIG. 5B is applied to the pixel values of the input image 41, since the voltage drop due to a decrease in the magnitude of current consumed by the plurality of pixels of an object portion 42 is not reflected in a process of compensating the pixel values due to the characteristics of the LED, the luminance uniformity may be degraded.

On the other hand, as illustrated in FIG. 5C, the display driver 200 according to the disclosure may compensate for the voltage drop considering a reduction in a partial current magnitude due to the black object of the input image 41.

The compensator CPST (210 in FIG. 4A) according to the disclosure may adjust the magnitude of the current consumed in the pixels in the column direction to which the driving voltage ELVDD is applied and may adjust the magnitude of the current consumed in the pixels in the row direction perpendicular to the column direction. Since the voltage drop is compensated for not only in the column direction according to the resistance of the mesh type structure of the display panel 300 but also considering the magnitude of the current flowing in the adjacent pixels in the column direction, the luminance uniformity of the display panel 300 may increase.

Figure 6A:
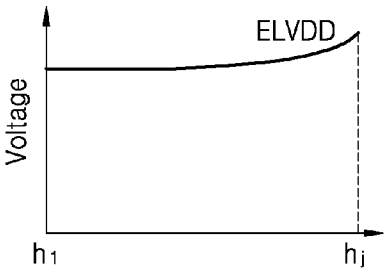
FIGS. 6A, 6B, and 6C are diagrams for explaining a voltage, luminance, and pixel values of a display panel, respectively, according to an embodiment.
Figure 6B:
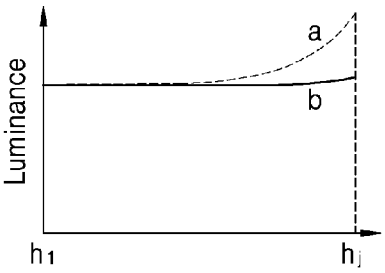
Figure 6C:
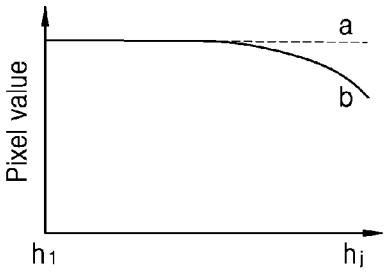

FIGS. 6A, 6B, and 6C are diagrams for explaining a voltage, luminance, and pixel values of the display panel 300, respectively, according to an embodiment.

The display panel 300 according to an embodiment may have a meshed structure as illustrated in FIG. 3, and descriptions of FIGS. 6A through 6C are given below with reference to FIG. 3.

FIG. 6A is a graph illustrating a distribution of the voltage level of the driving voltage ELVDD applied to the pixels PX distributed up to hl when the driving voltage ELVDD is applied to an hj side. FIG. 6B is a graph illustrating the luminance of the pixels PX distributed up to a position hl when the driving voltage ELVDD is applied to the hj side. FIG. 6C is a graph illustrating the pixel values of the pixels PX distributed up to the position hl when the driving voltage ELVDD is applied to the hj side. In other words, in the graphs of FIGS. 6A, 6B, and 6C, the horizontal axis may represent positions of the pixels PX with respect to a direction in which the driving voltage ELVDD is applied, and the vertical axis may represent the voltage, the luminance, or the pixel values.

In FIGS. 6A, 6B, and 6C, a case is assumed where a monochromatic image is input to the display panel 300. In FIGS. 6B and 6C, 'a' denotes the luminance and the pixel value of the case when the embodiment of the disclosure is not applied, and 'b' denotes the luminance and the pixel value of the case when the embodiment of the disclosure is applied.

According to an example embodiment, when the driving voltage ELVDD is applied to the pixels PX on the hj side in the display panel 300, the magnitude of the driving voltage ELVDD applied to the pixels PX may decrease toward hl. As described above, the pixels away from the position to which the driving voltage ELVDD is applied may have a voltage drop due to the resistance in the mesh type structure.

In the case of the display system 1000 to which the embodiment of the disclosure is not applied, since a monochromatic image is input to the display panel 300, the pixel values of the plurality of pixels PX may be independent of the direction in which the driving voltage ELVDD is applied and may have a uniform pixel value. However, as illustrated in FIG. 6A, the voltage drop of the display panel 300, that is, the voltage drop of the driving voltage ELVDD, may be greatest at the position hl and may hardly occur at the position hj. Accordingly, as illustrated in FIG. 6B, the luminance of the display panel 300 may be highest at the position hj and may be lowest at the position hl. Thus, although the display panel 300 is driven on the basis of an image having pixel values of the same gradation level, the luminance of the image displayed on the display panel 300 may differ depending on the position (for example, the position in the column direction).

On the other hand, in the case of the display system 1000 to which the embodiment of the disclosure is applied, the pixel values may be compensated considering the voltage drop of the driving voltage ELVDD, and thus, may be different depending on the position in the display panel 300. For example, as illustrated in FIG. 6C, the pixel value at the position hj may be smallest and the pixel value at the position hl may be largest. Accordingly, as illustrated in FIG. 6B, the luminance of the image displayed on the display panel 300 has a uniform value in a direction in which the driving voltage ELVDD is applied. In other words, according to the disclosure, the luminance uniformity of the display panel 300 may be improved by adjusting the pixel values, thereby providing a uniform color feeling to a user.

Figure 7:
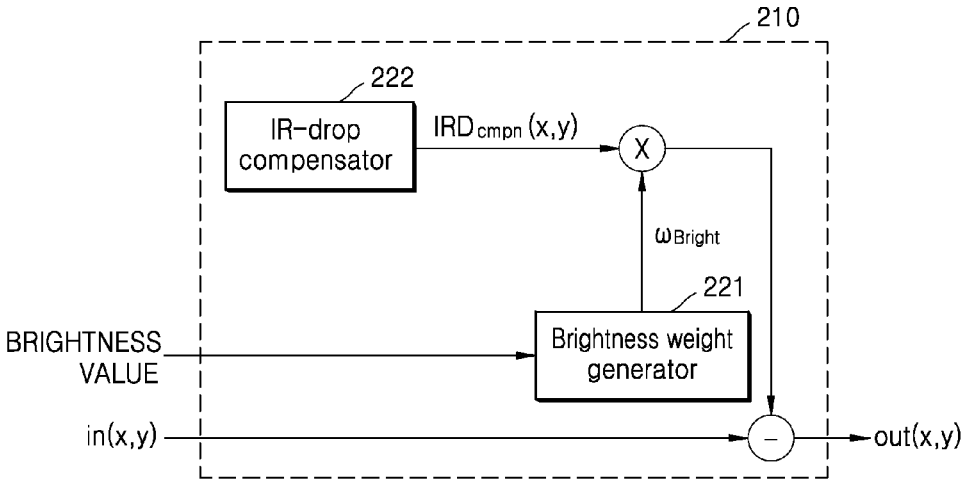
FIG. 7 is a block diagram illustrating a compensator according to an embodiment.

FIG. 7 is a block diagram illustrating the compensator CPST 210 according to an embodiment.

Referring to FIG. 7, the compensator CPST 210 may include a brightness weight generator 221 and an IR-drop compensator 222.

The IR-drop compensator 222, of the compensator CPST 210 described above in FIGS. 4A and 4B, may receive a pixel value in(x, y) of the input image and generate an IR-drop compensation value IRDcmpn(x, y) of the IR-drop compensation map IRDcmpn.

The compensator CPST 210 according to an embodiment may apply a value obtained by adjusting the value of the IR-drop compensation map IRDcmpn to the pixel value in(x,y) of the input image according to a brightness setting value of the display panel 300. In other words, the compensator CPST 210 may adjust the pixel value in(x,y) of the input image according to the brightness setting value BRIGHTNESS VALUE of the display panel 300 brightness weight.

The brightness weight generator 221 may receive luminance data (for example, FIG. 8A) according to the brightness setting value BRIGHTNESS VALUE of the display panel 300 from the outside.

For example, the brightness weight generator 221 may receive at least one of luminance data pre-stored in a storage unit (not shown) included in the display system 1000 and the brightness setting value BRIGHTNESS VALUE of the display panel 300. As another example, the brightness weight generator 221 may receive data from the host processor 100.

On the other hand, a voltage drop phenomenon may depend on current flowing in the display panel 300, and a factor for determining the current magnitude may be the brightness setting value BRIGHTNESS VALUE of the display panel 300. In this case, the brightness setting value BRIGHTNESS VALUE of the display panel 300 may be a pre-stored value or a value set by the user. Thus, when the brightness setting value BRIGHTNESS VALUE increases, the voltage-drop magnitude of the display panel 300 may increase.

The brightness weight generator 221 may receive the luminance data according to the brightness setting value BRIGHTNESS VALUE and generate the brightness weight (for example, FIG. 8B) according to the brightness setting value BRIGHTNESS VALUE.

The brightness weight generator 221 may select and output a brightness weight Ws oil corresponding to the brightness setting value BRIGHTNESS VALUE of the display panel 300 among a plurality of brightness weights according to the generated brightness setting values BRIGHTNESS VALUE. In addition, the IR-drop compensator 222 may output the IR-drop compensation value IRDcmpn(x,y) as in the above-described embodiment. The compensator CPST 210 may subtract a product of the brightness weight $W_{Bright}$ and the IR-drop compensation value IRDcmpn(x,y) from the pixel value in(x, y) of the input image, and may output a pixel value out(x, y) of the output image. The pixel value out(x, y) of the output image may be expressed as Formula 8 below, and $w_{calib}$ is an adjustment value for adjusting the voltage drop magnitude actually generated in the display panel 300 as described above.

$$out(x,y)=in(x,y)-\omega_{bright}*\omega_{calib}*IRD_{cmpn}(x,y) \quad \text{[Formula 8]}$$

Figure 9A:
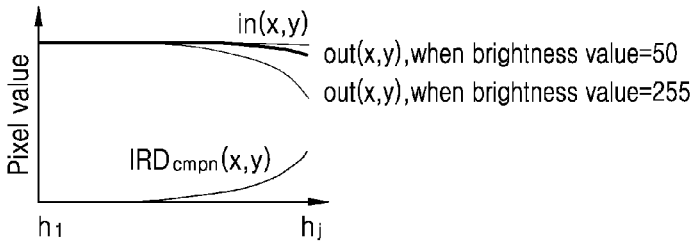
FIGS. 9A, 9B, and 9C illustrate diagrams for explaining a pixel value and luminance according to a brightness setting of a display panel according to an embodiment.

A result illustrated in FIG. 9A may be obtained by adjusting the pixel values of the compensator CPST 210 in FIG. 7.

Figure 8B:
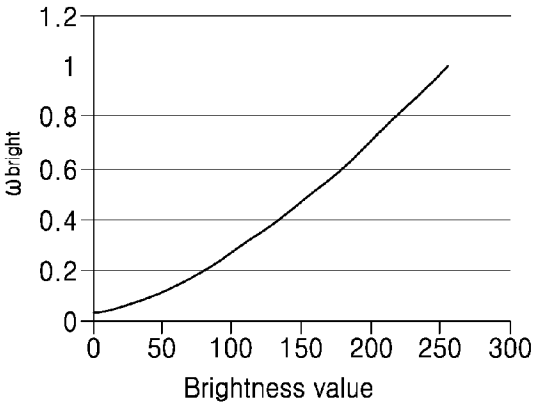
FIGS. 8A and 8B illustrate diagrams for explaining an output luminance of a display panel and a brightness weight generated by a compensator depending on a brightness setting value, respectively, according to an embodiment.
Figure 8A:
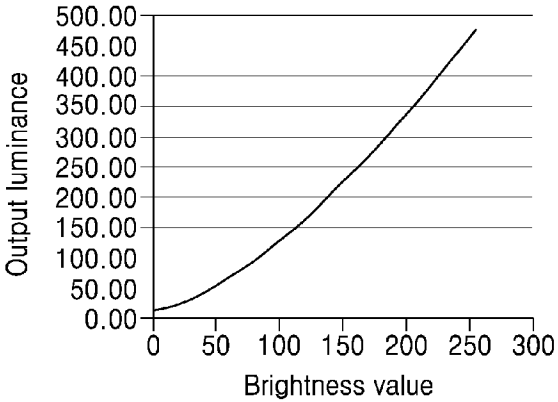

FIGS. 8A and 8B illustrate diagrams for explaining an output luminance of the display panel 300 and the brightness weight generated by the compensator CPST 210 depending on the brightness setting value BRIGHTNESS VALUE, respectively, according to an embodiment.

In the graph of FIG. 8A, the horizontal axis may represent the brightness setting value BRIGHTNESS VALUE, and the vertical axis may represent the output luminance of the display panel 300 according to the brightness setting value BRIGHTNESS VALUE. In the graph of FIG. 8B, the horizontal axis may represent the brightness setting value BRIGHTNESS VALUE of the display panel 300, and the vertical axis may represent the brightness weight $W_{Bright}$ according to the brightness setting value BRIGHTNESS VALUE. Numerical values shown on the horizontal and vertical axes are only example values and may include other numerical values.

Referring to FIG. 8A, as the brightness setting value BRIGHTNESS VALUE of the display panel 300 increases, the output luminance of the display panel 300 may increase. For example, the output luminance of the display panel 300 may exponentially increase.

As the brightness setting value BRIGHTNESS VALUE of the display panel 300 changes, the amount of current flowing in the pixels PX may change, and the magnitude of the voltage drop may also change. Accordingly, the brightness weight generator 221 may generate the brightness weight $W_{Bright}$ according to the brightness setting value BRIGHTNESS VALUE of FIG. 8B having a curve similar to that of FIG. 8A.

Figure 9B:
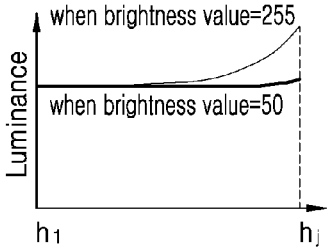
Figure 9C:
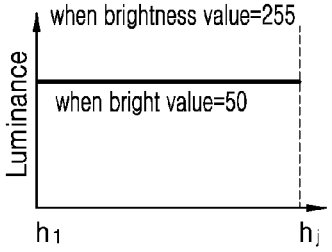

FIGS. 9A, 9B, and 9C illustrate diagrams for explaining the pixel value and the luminance according to the brightness setting value BRIGHTNESS VALUE of the display panel 300 according to an embodiment.

FIG. 9A illustrates the pixel value in the direction in which the driving voltage ELVDD is applied. FIG. 9B illustrates the luminance value in the direction in which the driving voltage ELVDD is applied, when the pixel values are not adjusted. FIG. 9C illustrates the luminance value in the direction in which the driving voltage ELVDD is applied, when the pixel values are adjusted.

When the display panel 300 is driven on the basis of the pixel value in(x, y) of the input image without compensation according to the voltage drop with respect to the pixel value in(x, y) of the input image, as illustrated above in FIG. 9B, the image displayed on the display panel 300 may have non-uniform luminance depending on the position on the display panel 300. In addition, as illustrated in FIG. 9B, a degree of non-uniformity of the luminance may differ depending on the brightness setting value BRIGHTNESS VALUE. In other words, as the brightness setting value BRIGHTNESS VALUE increases, the amount of current increases and a variation in the magnitude of the voltage drop depending on the direction in which the driving voltage ELVDD is applied may increase, and accordingly, luminance deviation may increase.

However, according to one example of the disclosure, when the brightness setting value BRIGHTNESS VALUE is about 50, the compensator CPST 210 may somewhat reduce the pixel value out(x,y) of the output image compared to the pixel value in(x,y) of the input image. As another example, when the brightness setting value BRIGHTNESS VALUE is about 255, the pixel value may be further reduced from that when the brightness setting value BRIGHTNESS VALUE is about 50. In other words, the pixel values compensated for the brightness setting values BRIGHTNESS VALUE of about 50 and about 255 may be affected by the brightness weight $W_{Bright}$.

Accordingly, a uniform luminance distribution may be obtained in the direction in which the driving voltage ELVDD of the display panel 300 is applied.

Figure 10A:
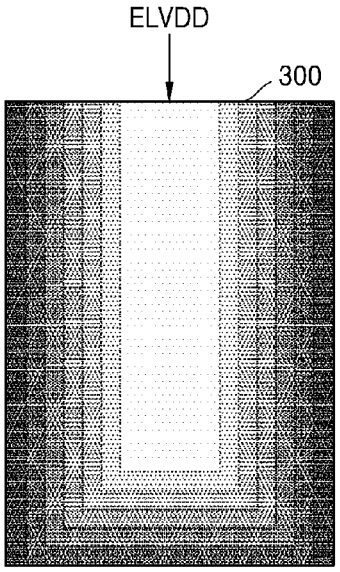
FIGS. 10A and 10B are output images of a display panel according to an embodiment.
Figure 10B:
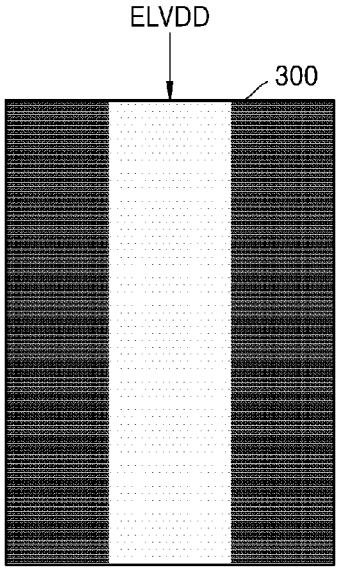

FIGS. 10A and 10B are diagrams for explaining output images of the display panel 300 according to an embodiment.

FIGS. 10A and 10B both illustrate images output by the display panel 300 when an input image, in which a white color monochrome object is included on a black color monochromatic background, is provided to the display panel 300 (or provided to the display driver 200). In addition, FIGS. 10A and 10B both illustrate images when the driving voltage ELVDD is applied to a top center portion of the display panel 300.

Referring to FIG. 10A, when the driving voltage ELVDD is applied to the top center portion of the display panel 300, the luminance may not be uniform due to the voltage drop in the display panel 300. In other words, the voltage drop generated on a side where the driving voltage ELVDD is applied is small and thus, a white color monochromatic object may be expressed in white color. However, a large voltage drop occurs at a bottom side of the display panel 300, which is far from the side where the driving voltage ELVDD is applied, and thus, the white color monochromatic object may be expressed with a gradually decreasing luminance. In other words, a luminance distribution from a top side to a bottom side of the display panel 300 may not be uniform.

In addition, a high driving voltage ELVDD may be applied to the pixels PX corresponding to the white color object, and a low driving voltage ELVDD may be applied to the pixels PX corresponding to the black color background. Accordingly, in the pixels PX corresponding to the white color object, the voltage drop may occur according to current leaked by the pixels PX corresponding to the black color background, and a non-uniform luminance distribution may occur on left and right sides of the white color object.

On the other hand, in the case of FIG. 10B in which a compensation method for the pixel values according to the embodiment of the disclosure is applied, the compensator CPST 210 may generate the output image by adjusting the pixel values as the voltage drop occurs, and thus, the input image of the white color monochromatic object may be output by the display panel 300 with uniform luminance and a uniform color feeling.

Figure 11:
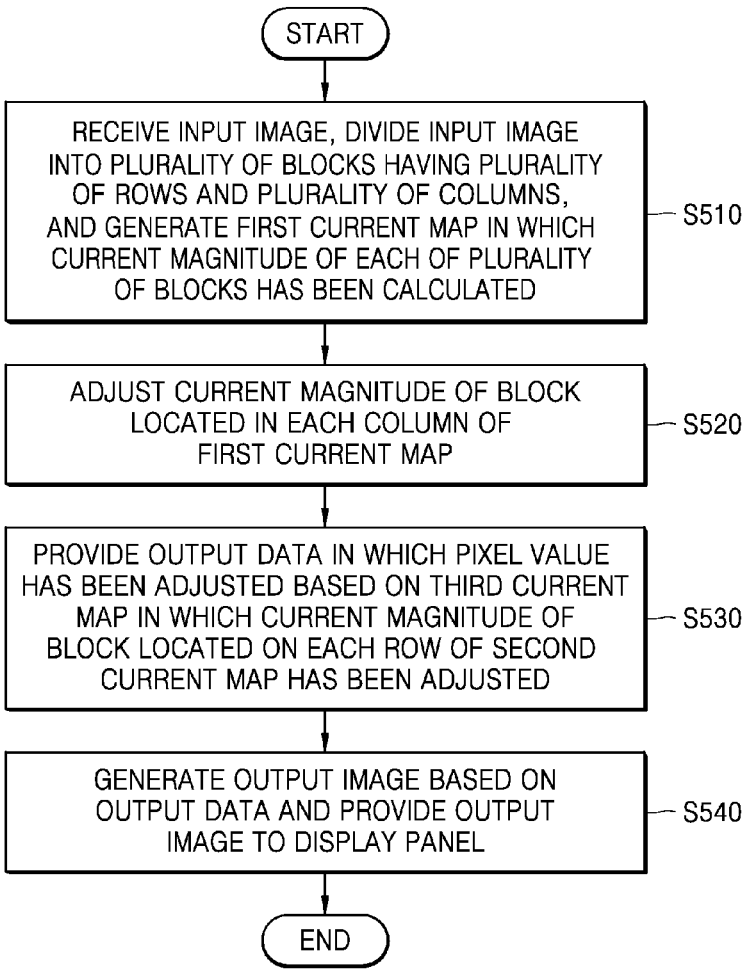
FIG. 11 is a flowchart of an operation method of a display driver according to an embodiment.

FIG. 11 is a flowchart of an operation method of the display driver according to an embodiment.

According to an embodiment of the disclosure, the display driver 200 may receive the input image, divide the input image into the plurality of blocks having a plurality of rows and a plurality of columns, and generate the first current map CM1 that has calculated the current magnitude of each of the plurality of blocks (S510). In this case, the current magnitude of each of the blocks of the first current map CM1 may have the current magnitude which is obtained by calculating the current magnitude in units of pixels as an average value of the current magnitude in units of blocks. In addition, the number of blocks may be a certain value or a value input by the user, and the number of blocks may be less than the number of pixels PX.

The display driver 200 may generate the second current map CM2 by adjusting the current magnitudes of the plurality of blocks located in respective columns of the first current map CM1 (S520). The display driver 200 may generate the second current map CM2 by sequentially adding the current magnitudes from the block located on an opposite side of the side to which the driving voltage ELVDD is applied.

The display driver 200 may provide the output data in which the pixel values are adjusted based on the third current map CM3 in which the current magnitudes of the blocks located on respective rows of the second current map CM2 have been adjusted (S530). For example, when the driving voltage ELVDD is input via one terminal, the display driver 200 may generate the third current map CM3 by applying a Gaussian filter around the current magnitude of the block proximate to the one terminal. As another example, the same may be true even when the driving voltage ELVDD is input via a plurality of terminals. The display driver 200 may generate the IR-drop map IRD based on the third current map CM3, generate the IR-drop compensation map IRDcmpn by using the values included in the IR-drop map IRD, and adjust the pixel values by applying the input image to the IR-drop compensation map IRDcmpn. Thereafter, the display driver 200 may generate the output image based on the output data in which the pixel values has been adjusted and provide the output image to the display panel 300 (S540).

Figure 12:
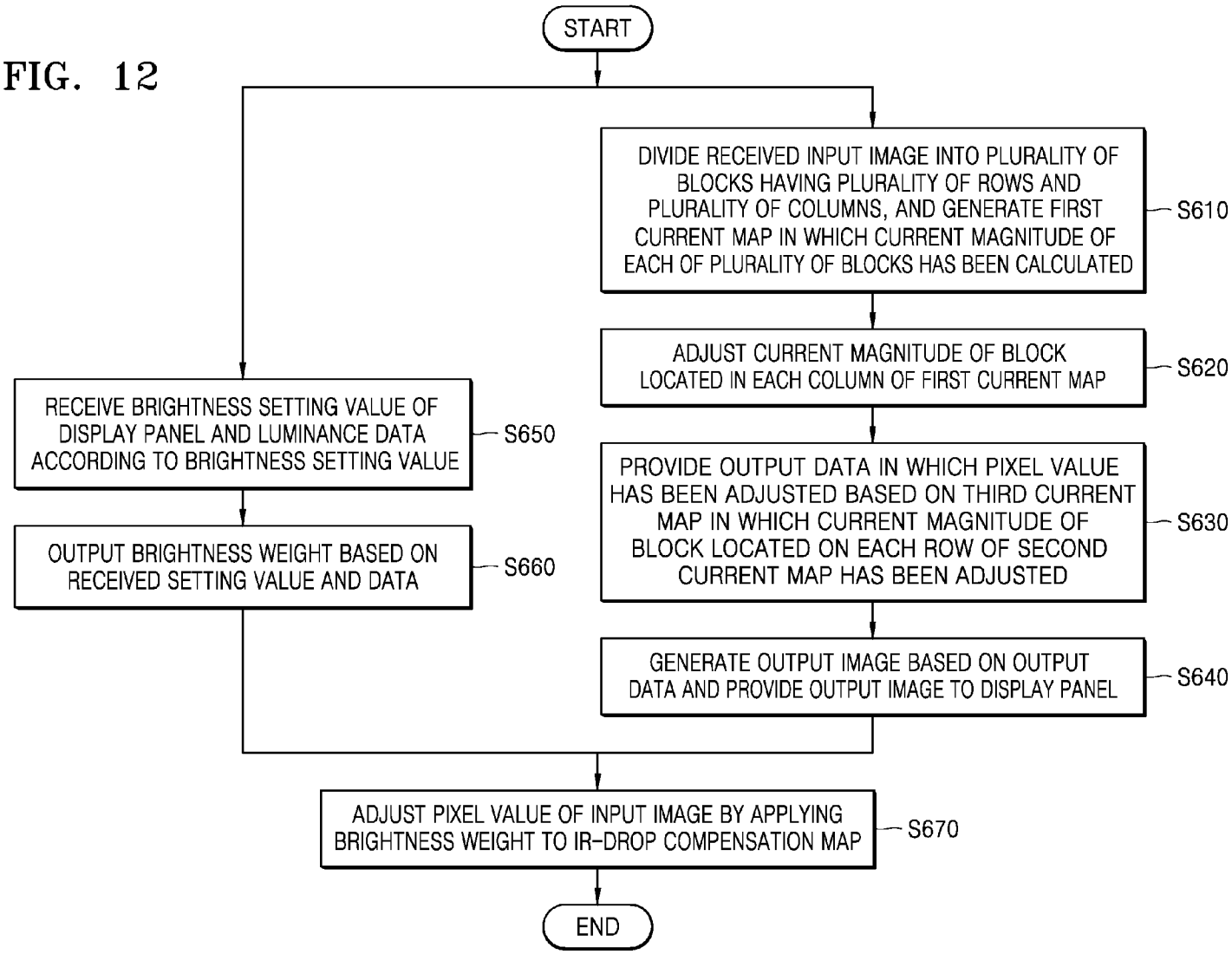
FIG. 12 is a flowchart of an operation method of a compensator according to an embodiment.

FIG. 12 is a flowchart of an operation method of the compensator CPST 210 according to an embodiment.

According to the embodiment of the disclosure, the compensator CPST 210 may receive the input image and output the IR-drop compensation map IRDcmpn (S610 through S640). Since these operations are similar to those of the display driver 200 described above with reference to operations S510 through S540 of FIG. 11, detailed description thereof operations S610 through S640 are omitted.

On the other hand, as described above with reference to FIGS. 7 through 9, the compensator CPST 210 may receive the brightness setting value BRIGHTNESS VALUE of the display panel 300 and the luminance data according to the brightness setting value BRIGHTNESS VALUE (S650), and may output the brightness weight based on the received brightness setting value BRIGHTNESS VALUE and the received luminance data (S660). In this case, the brightness weight $W_{Bright}$ may be data having a curve similar to that of the luminance data according to the brightness setting value BRIGHTNESS VALUE.

The compensator CPST 210 may adjust the pixel value of the input image based on the output IR drop compensation map IRDcmpn and the brightness weight $W_{Bright}$ (S670). For example, the value obtained by applying the brightness weight Ws oil to the IR-drop compensation map IRDcmpn may be subtracted from the pixel value of the input image. Depending on the brightness of the display panel 300, that is, the brightness according to the brightness setting value BRIGHTNESS VALUE, the magnitude of the voltage drop may change. In particular, when the brightness is set relatively high, the voltage drop may be greater than that when the brightness is set relatively low, and thus, the non-uniformity of luminance may be higher. Therefore, in compensating pixel values for preventing non-uniformity of luminance due to a voltage drop, luminance of a display panel may be maintained uniform regardless of a brightness setting value by compensating the pixel values based on not only an IR-drop compensation map but also a brightness weight based on the brightness setting value.

As is traditional in the field, embodiments may be described and illustrated in terms of blocks which carry out a described function or functions. These blocks, which may be referred to herein as units or modules or the like, are physically implemented by analog and/or digital circuits such as logic gates, integrated circuits, microprocessors, microcontrollers, memory circuits, passive electronic components, active electronic components, optical components, hardwired circuits and the like, and may optionally be driven by firmware and/or software. The circuits may, for example, be embodied in one or more semiconductor chips, or on substrate supports such as printed circuit boards and the like. The circuits constituting a block may be implemented by dedicated hardware, or by a processor (e.g., one or more programmed microprocessors and associated circuitry), or by a combination of dedicated hardware to perform some functions of the block and a processor to perform other functions of the block. Each block of the embodiments may be physically separated into two or more interacting and discrete blocks without departing from the scope of the disclosure. Likewise, the blocks of the embodiments may be physically combined into more complex blocks without departing from the scope of the disclosure.

As described above, embodiments have been disclosed in the drawings and specification. While the embodiments have been described herein with reference to specific terms, it should be understood that they have been used only for the purpose of describing the technical idea of the disclosure and not for limiting the scope of the disclosure as defined in the claims. Therefore, it will be clearly understood by one of ordinary skill in the art that various modifications and equivalent embodiments are possible without departing from the scope of the disclosure. Accordingly, the true scope of protection of the disclosure should be determined by the technical idea of the following claims.

What is claimed is:

1. A display driver comprising:

a compensator that:

divides an input image into a plurality of blocks having a plurality of columns and a plurality of rows, generates a first current map in which a current magnitude corresponding to each of the plurality of blocks has been calculated, generates a second current map based on a sequential summation of the current magnitude of the block located on each column of the first current map in a column direction, and generates output data by compensating pixel values of the input image based on a third current map in which the current magnitude of the block located on each row of the second current map has been adjusted with respect to a position in a row direction; and a data driver that generates an output image based on the output data and provides the output image to a display panel.

2. The display driver of claim 1, wherein the compensator determines a new current magnitude corresponding to a first block by adding a current magnitude of the first block comprised in the first current map and a current magnitude of a second block, which is located on a row adjacent to the first block.

3. The display driver of claim 2, wherein the compensator:

generates the third current map by adjusting current magnitudes corresponding to each row of blocks comprised in the second current map by applying a preset filter, and compensates the pixel values based on an IR-drop map which is generated by multiplying the third current map by a resistance value of the display panel corresponding to each of the blocks.

4. The display driver of claim 3, wherein the IR-drop map is generated by multiplying the resistance value by an average of a current magnitude of a third block comprised in the third current map and a current magnitude of a fourth block that is located on a row adjacent to the third block.

5. The display driver of claim 3, wherein the compensator:

generates an IR-drop compensation map by subtracting a voltage drop of each of the plurality of blocks from a maximum voltage drop magnitude comprised in the IR-drop map, and generates the output data by applying the IR-drop compensation map to the input image.

6. The display driver of claim 5, wherein:

the compensator generates an IR-drop compensation map having a voltage compensation magnitude in units of pixels from the IR-drop compensation map having a voltage compensation magnitude in units of blocks, and the IR-drop compensation map having the voltage compensation magnitude in units of pixels has a same resolution as the input image.

7. The display driver of claim 6, wherein the compensator:

generates compensation data by multiplying the IR-drop compensation map having the voltage compensation magnitude in units of pixels by an adjustment coefficient, and generates an output data by subtracting the compensation data from the pixel values of the input image.

8. The display driver of claim 7, further comprising:

a brightness weight generator that generates a brightness weight based on luminance data according to a brightness setting value of the display panel, wherein the compensator generates the output data based on the pixel values of the input image and the brightness weight.

9. The display driver of claim 8, wherein the compensator decreases a pixel value of the output image as the brightness setting value of the display panel increases, according to the brightness weight.

10. The display driver of claim 8, wherein the compensator:

receives luminance data according to the brightness setting value of the display panel and obtains an adjustment coefficient, multiplies the IR-drop compensation map by the adjustment coefficient and the brightness weight, and provides, to the data driver, an output image in which a result of multiplying the IR-drop compensation map by the adjustment coefficient and the brightness weight is subtracted from a pixel value of the input image.

11. The display driver of claim 3, wherein:

the first block is a block located on a second side opposite to a first side where a driving voltage is applied, and the second block is adjacent to the first block in a direction in which the driving voltage is applied.

12. The display driver of claim 11, wherein:

the data driver provides the output image to the display panel in which resistive elements are connected in a meshed structure, a self-luminous element is arranged at each node, and a driving voltage input terminal is arranged on the first side.

13. The display driver of claim 11, wherein, a voltage magnitude corresponding to a block included in a row proximate to the first side is zero in the IR-drop map.

14. An operation method of a display driver, the operation method comprising:

generating a first current map by:

dividing a received input image into a plurality of blocks having a plurality of rows and a plurality of columns, and calculating a current magnitude corresponding to each of the plurality of blocks based on pixel values comprised in each of the plurality of blocks;

generating a second current map by sequential summation of current magnitudes of blocks located in each column of the first current map;

generating a voltage drop compensation map based on a third current map in which weights based on positions in a row direction are applied to current magnitudes of blocks located in each row of the second current map;

generating output data by compensating pixel values based on the voltage drop compensation map; and generating an output image based on the output data and providing the output image to a display panel.

15. The operation method of claim 14, wherein the generating of the second current map comprises determining a new current magnitude of a first block by adding an existing current magnitude of the first block comprised in the first current map and a current magnitude of a second block, which is located on a row adjacent to the first block.

16. The operation method of claim 15, wherein:

the generating of the third current map comprises adjusting a current magnitude of each row comprised in a block of the second current map by applying a preset filter to the blocks of the second current map; and the generating of the output data comprises generating the output data in which a pixel value is adjusted based on an IR-drop map obtained by multiplying the third current map by a resistance value of the display panel corresponding to each block.

17. The operation method of claim 16, wherein:

the generating of the output data comprises generating an IR-drop compensation map by subtracting a voltage drop magnitude of each of the plurality of blocks from a maximum voltage drop magnitude comprised in the IR-drop map, and generating the output data by applying the IR-drop compensation map to the input image.

18. The operation method of claim 14, further comprising:

receiving the output data in which a pixel value has been adjusted and adjusting the pixel value of the output image according to brightness setting data of the display panel, wherein the providing of the output image to the display panel comprises outputting the output image in which the pixel value of the output image has been adjusted according to the brightness setting data.

19. The operation method of claim 18, wherein the adjusting reduces the pixel value of the output image as a brightness value according to the brightness setting data increases.

20. A display system comprising:

a display driver that:

divides an input image into a plurality of blocks having a plurality of columns and a plurality of rows, generates a first current map in which a current magnitude corresponding to each of the plurality of blocks has been calculated, generates a second current map based on a sequential summation of the current magnitude of the block located on each column of the first current map in a column direction, generates output data by compensating pixel values of the input image based on a third current map in which the current magnitude of the block located on each row of the second current map has been adjusted with respect to a position in a row direction, and generates an output image based on the output data; and a display panel that displays the output image.

* * * * *